US005560237A

United States Patent [19]

Yasuda et al.

[11] Patent Number: 5,560,237

[45] Date of Patent: Oct. 1, 1996

[54] ROLLING MILL AND METHOD

[76] Inventors: Kenichi Yasuda, 1181-80, Higashi-ishikawa, Katsuta-shi, Ibaraki-ken; Yukio Hirama, 2151-16, Motoyoshidacho, Mito-shi, Ibaraki-ken; Kenjiro Narita, 32-3-402, Nishi-narusawacho 1-chome, Hitachi-shi, Ibaraki-ken; Koji Satou, 31-32, Aitacho 3-chome, Hitachi-shi, Ibaraki-ken; Yoshio Takakura, 37-4, Nishi-narusawacho 4-chome, Hitachi-shi, Ibaraki-ken; Hiroyuki Shiraiwa, 44-33, Ishinazakacho 1-chome, Hitachi-shi, Ibaraki-ken, all of Japan

[21] Appl. No.: 230,344

[22] Filed: Apr. 20, 1994

[30] Foreign Application Priority Data

Apr. 22, 1993 [JP] Japan ..... 5-096279

[51] Int. Cl.[6] ..... B21B 13/14; B21B 37/08

[52] U.S. Cl. ..... 72/13.4; 72/241.8; 72/243.2

[58] Field of Search ..... 72/21, 241.4, 241.8, 72/243.2, 243.4, 13.4

[56] References Cited

U.S. PATENT DOCUMENTS

| | | | |
|---|---|---|---|
| 4,719,784 | 1/1988 | Matsumoto | 72/241.8 |
| 5,406,817 | 4/1995 | Takamura et al. | 72/21 |

FOREIGN PATENT DOCUMENTS

| | | |
|---|---|---|
| 0118812 | 9/1984 | European Pat. Off. . |
| 0416880 | 3/1991 | European Pat. Off. . |
| 94106283 | 7/1994 | European Pat. Off. . |
| 6-0018206 | 1/1985 | Japan . |
| 6-1182807 | 8/1986 | Japan . |
| 6-3252608 | 10/1988 | Japan . |
| 01180708 | 7/1989 | Japan . |
| 05050109 | 3/1993 | Japan . |

*Primary Examiner*—Lowell A. Larson
*Assistant Examiner*—Thomas C. Schoeffler
*Attorney, Agent, or Firm*—Bardehle, Pagenberg, Dost, Altenburg, Frohwitter, Geissler & Partners

[57] ABSTRACT

To eliminate a vertically asymmetrical deflection, a rolling mill comprises a device for measuring horizontal deflections of upper and lower work rolls 2, 3 during rolling, a device for comparing values measured on the upper and lower sides and calculating the difference therebetween, and a horizontal deflection controller four determining whether the difference exceeds a predetermined range or not and imparting a horizontal bending to at least one of the work rolls. To eliminate a transversely asymmetrical deflection, a rolling mill comprises a device for measuring horizontal deflections of at least one of the work rolls at axially spaced positions during rolling, a device for comparing values measured on at the axially spaced positions and calculating the difference therebetween, and a horizontal deflection controller for determining whether the difference exceeds a predetermined range or not and imparting a horizontal bending to the one work roll at least one of the axially spaced positions. This prevents an adverse effect by the work rolls being horizontally deflected in a vertically or transversely asymmetrical way, reduces the diameter of the work rolls, and increases the allowable rolling load. Stable rolling of high-quality strips with good shape or flatness is thus achieved.

19 Claims, 12 Drawing Sheets

ROLLING MILL AND METHOD

BACKGROUND OF THE INVENTION

The present invention relates to a strip rolling mill and method, and more particularly to a rolling mill having small-diameter work rolls suitable for rolling of hard or extremely thin strips, and a rolling method for use with the rolling mill.

Hitherto, small-diameter work rolls have been employed for rolling of hard or extremely thin strips made of, e.g., stainless steel. As the diameter of work rolls is reduced, bending rigidity becomes smaller correspondingly, which causes a deflection in the horizontal plane, particularly, as a problem. Therefore, cluster type multi-high rolling mills including a Sendzimir mill, and rolling mills equipped with a horizontal deflection preventing mechanism to horizontally support work roll barrels by support rolls, as disclosed in JP, A, 60-18206, have been developed. However, because these rolling mills employ support rolls divided in the axial direction, the divided rolls produce transferred marks on strips, which deteriorate the strip's surface texture. To deal with such a problem, the applicant has previously proposed a rolling mill, as disclosed in JP, A, 5-50109, which prevents deterioration of the strip's surface texture and permits practical use of small-diameter work rolls.

In that rolling mill, multiple rows of support rolls are installed on each of the entry and delivery (back and front) sides so as to support both end portions of a work roll barrel outwardly of the passage of strips having a maximum width, and outermost one of the support rolls is associated with a cylinder for bending the work roll horizontally. A horizontal deflection is prevented by the following three measures; (a) the work roll is set to such an offset position before the start of rolling as that the horizontal force exerted on the work roll will be 0, (b) the offset position of the work roll is also adjusted during the rolling so that the horizontal force is kept at 0, and (c) the horizontal deflection is detected during the rolling and the bending cylinder is controlled so that the detected horizontal deflection is kept at 0. This type of mill will be hereinafter referred to as a UC-1F mill.

JP, A, 61-182807 also discloses a rolling mill provided with measures similar to the above (a) and (b). Further, JP, A, 1-180708 proposes a technique of not only controlling the horizontal deflection of a work roll through an adjustment of the offset position of the work roll and horizontal bending control by a bending cylinder, but also performing the above deflection control in combination with a bending adjustment of the work roll, thereby controlling the shape (flatness) of a strip under rolling. Additionally, JP, A, 63-252608 pertains to a mill using support rolls for supporting each work roll along substantially its entire length, and discloses a method of adjusting the offset position of the work roll so that the horizontal forces are equal to each other vertically and transversely.

SUMMARY OF THE INVENTION

With the UC-1F mill disclosed in JP, A, 5-50109, rolling of hard or very thin strips can be performed while providing the strips with a good surface texture. However, the following problem about vertical and transverse asymmetry has come out.

To prevent the horizontal deflection of a work roll, as pointed out at (b) and (c) above, the UC-1F mill is designed so as to adjust the offset position of the work roll so that the horizontal force is kept at 0 during the rolling, and to detect the horizontal deflection and control the bending cylinder so that the horizontal deflection is kept at 0. Generally, the rolling conditions, e.g., the coefficients of roll-to-strip friction, on the upper and lower sides are rarely coincident to each other, and other parameters such as a rolling torque are also slightly different between the upper and lower sides in many cases. Therefore, the offset position of the work roll where the horizontal force becomes 0 on the upper side is often shifted from the offset position of the work roll where the horizontal force becomes 0 on the lower side. If the offset positions of the work rolls are shifted between the upper and lower sides, the roll centers are pushed in opposite directions to deflect away from each other depending on the rolling conditions. In other words, the center of the work roll locating at an outer position is forced to further deflect outward, while the center of the work roll locating at an inner position is forced to further deflect inward. Accordingly, the amount of shift between both the roll centers is further increased. The bending rigidity of each work roll serves to resist such a tendency. If the work roll diameter is large, the increasing shift is balanced by a certain amount of deflection. But when the work roll diameter is too small to provide a sufficient resistance, the oppositely deflected condition of the work rolls is amplified acceleratingly and the stable rolling is no longer achieved. Thus, there has been a limit in reducing the work roll diameter. If the work roll diameter is reduced beyond the limit, the rolling load cannot be so increased and must be restricted to a very small value.

On the other hand, although the horizontal bending control is performed simultaneously with the adjustment of (b) so that the horizontal deflections of the upper and lower rolls are kept at 0, the deflection amounts are changed acceleratingly as described above, and the control by the bending cylinder cannot follow the change. Therefore, the opposed deflections on the upper and lower sides are excessively increased, and the shape or flatness of strips is badly worsened. In the extreme case, the retaining forces of the support rolls may no longer accommodate an increase in the horizontal force due to the shift of the work rolls, and hence the work rolls may be pushed out of place to disable the mill from continuing the rolling.

As pointed at (a) above, the UC-1F mill is further designed to set the work roll to such an offset position before the start of rolling as that the horizontal force exerted on the work roll will be 0. If the rolling conditions are not changed, that setting allows the horizontal force to be kept at 0 and no horizontal deflection is caused. However, slight change in the rolling conditions is not avoidable when the work roll is accelerated and decelerated, thereby causing the horizontal deflection which leads to the above-described problem.

With regard to the traverse direction of strips, the rolling conditions are different in not a few cases. In this case, even if the control is performed so that the horizontal force is kept at 0 and the deflection at the roll center is also kept at 0, the work roll may be subject to a transversely asymmetrical horizontal deflection and hence the strip shape may be transversely asymmetrical. It is difficult to remedy such a condition.

A first object of the present invention is to provide a rolling mill and method which can realize stable rolling of high-quality strips with good shape or flatness by using small-diameter work rolls.

A second object of the present invention is to provide a rolling mill and method which can realize rolling of high-quality strips with good shape or flatness by using small-diameter work rolls, while preventing transversely asymmetrical horizontal deflections of the work rolls.

A third object of the present invention is to provide a rolling mill and method which can realize rolling of high-quality strips with good shape or flatness by using small-diameter work rolls, without needing a special remedy for strip shapes when the upper and lower work rolls are deflected in the same direction.

To achieve the above first object, according to the present invention, there is provided a rolling method for use with a rolling mill comprising upper and lower work rolls, upper and lower backup rolls, horizontal supporting means for respectively supporting the upper and lower work rolls in the horizontal direction, and horizontal bending means for respectively imparting a horizontal bending to the upper and lower work rolls, wherein the method comprises the steps of measuring horizontal deflections of the upper and lower work rolls during rolling, and controlling the horizontal bending means for at least one of the upper and lower work rolls so that the difference between a value measured on the upper work roll and a value measured on the lower work roll falls within a predetermined range.

The rolling method of the present invention prevents the difference between deflection amounts of the upper and lower work rolls from increasing, and hence prevents the work rolls from deflecting in opposed directions. In other words, the upper and lower work rolls are always deflected in the same direction in the same amount. It is therefore possible to prevent the roll barrel centers from being so shifted from each other as to aggravate the oppositely deflected condition of the work rolls acceleratingly, and to achieve stable rolling of high-quality strips with good shape or flatness.

By combining the above control for making small the difference between deflection amounts of the upper and lower work rolls with later-described control, related to the second embodiment of the invention, for making small a transversely asymmetrical horizontal deflection of the work roll, both the vertically and transversely asymmetrical deflections are eliminated and high-quality strips with better shape or flatness are obtained under stable rolling.

The control of the invention is intended to make small the difference between deflection amounts of the upper and lower work rolls, but not eliminate the deflections themselves when the upper and lower work rolls are deflected in the same direction. On the other hand, as describe later in connection with the third object of the invention, there exists an offset position at which the strip shape is not affected by the horizontal deflection even if occurs. Therefore, by setting the work rolls to such offset positions before the start of rolling, the strip shape does not change even if the work rolls are deflected. As a result, stable rolling of high-quality strips with good shape or flatness can be achieved without needing a special remedy for the strip shape such as application of bending forces.

Further, the above rolling method of the invention may be combined with the above-described measure (a) disclosed in JP, A, 5-50109 such that the upper and lower work rolls are set before the start of rolling to offset positions at which horizontal forces exerted on the work roll become 0. By so setting, the horizontal deflections due to the horizontal forces are reduced and high-quality strips with better shape or flatness are obtained under stable rolling. In this case, the rolling method of the invention may also be combined with the above-described measure (b) disclosed in JP, A, 5-50109 such that the offset positions of the work rolls are regulated during the rolling so as to keep the horizontal force exerted on at least one work roll at 0. As a result, the horizontal deflection control is performed in a more reliable manner during the rolling. Further, even during the transient period from the start of rolling until a steady operating condition is reached, it is possible to reduce the horizontal deflections and to achieve stable-rolling with superior control on shape or flatness.

To achieve the above second object, according to the present invention, there is also provided a rolling method for use with a rolling mill comprising upper and lower work rolls, upper and lower backup rolls, horizontal supporting means for respectively supporting the upper and lower work rolls in the horizontal direction, and horizontal bending means for respectively imparting a horizontal bending to the upper and lower work rolls, wherein the method comprises the steps of measuring a horizontal deflection of at lease one of the upper and lower work rolls at axially spaced positions during rolling, and controlling the horizontal bending means for the one work roll so that the difference between values measured at the axially spaced positions falls within a predetermined range.

With the above rolling method of the invention, the horizontal deflections at the axially spaced positions on the work roll are controlled so that they are always substantially equal to each other and, therefore, a transversely asymmetrical deflection is not caused. Accordingly, the horizontal deflections are always transversely symmetrical even if occur, and a resultant strip shape is also always transversely symmetrical. It is thus possible to achieve rolling of high-quality strips with good shape or flatness.

To achieve the above third object, according to the present invention, there is further provided a rolling method for use with a rolling mill comprising upper and lower work rolls, upper and lower backup rolls, horizontal supporting means for respectively supporting the upper and lower work rolls in the horizontal direction, and horizontal bending means for respectively imparting a horizontal bending to the upper and lower work rolls, the upper and lower work rolls being disposed to be offset with respect to the upper and lower backup rolls in the direction of a pass line, wherein rolling is started after setting the upper and lower work rolls to predetermined offset positions which are determined by rolling conditions such as a strip thickness, strip width and rolling load, and at which the strip shape is not affected by the horizontal deflections of the work rolls.

As the result of studies conducted by the inventors, it has been found that there exists an offset position at which the strip shape is not affected by the horizontal deflection even if occurs. Based on this finding, the rolling method of the invention for achieving the third object is to set the work rolls to such offset positions before the start of rolling. These offset positions are not always coincident with the offset positions at which the horizontal forces become 0. By so setting, however, the strip shape does not change even if the work rolls are deflected, and hence stable rolling of high-quality strips with good shape or flatness can be achieved without needing a special remedy for the strip shape.

In addition, to achieve the above first object, according to the present invention, there is provided a rolling mill comprising upper and lower work rolls, upper and lower backup rolls, horizontal supporting means for respectively supporting the upper and lower work rolls in the horizontal direction, and horizontal bending means for respectively imparting a horizontal bending to the upper and lower work rolls, wherein the mill comprises means for measuring horizontal deflections of the upper and lower work rolls during rolling, and first horizontal deflection control means for controlling the horizontal bending means for at least one of the upper and lower work rolls so that the difference between a value measured on the upper work roll and a value measured on the lower work roll falls within a predetermined range.

To achieve the above third object, according to the present invention, there is also provided a rolling mill comprising upper and lower work rolls, upper and lower backup rolls, horizontal supporting means for respectively supporting the upper and lower work rolls in the horizontal direction, and horizontal bending means for respectively imparting a horizontal bending to the upper and lower work rolls, wherein the mill comprises means for measuring a horizontal deflection of at lease one of the upper and lower work rolls at axially spaced positions during rolling, and horizontal deflection control means for controlling the horizontal bending means for the one work roll so that the difference between values measured at the axially spaced positions falls within a predetermined range.

To achieve the above third object, according to the present invention, there is further provided a rolling mill comprising upper and lower work rolls, upper and lower backup rolls, horizontal supporting means for respectively supporting the upper and lower work rolls in the horizontal direction, and horizontal bending means for respectively imparting a horizontal bending to the upper and lower work rolls, the upper and lower work rolls being disposed to be offset with respect to the upper and lower backup rolls in the direction of a pass line, wherein the mill comprises means for calculating predetermined offset positions which are determined by rolling conditions such as a strip thickness, strip width and rolling load, and at which the strip shape is not affected by the horizontal deflections of the upper and lower work rolls, and means for setting the work rolls to the offset positions.

DETAILED DESCRIPTION OF THE PREFERRED EMBODIMENTS

Figure 1:
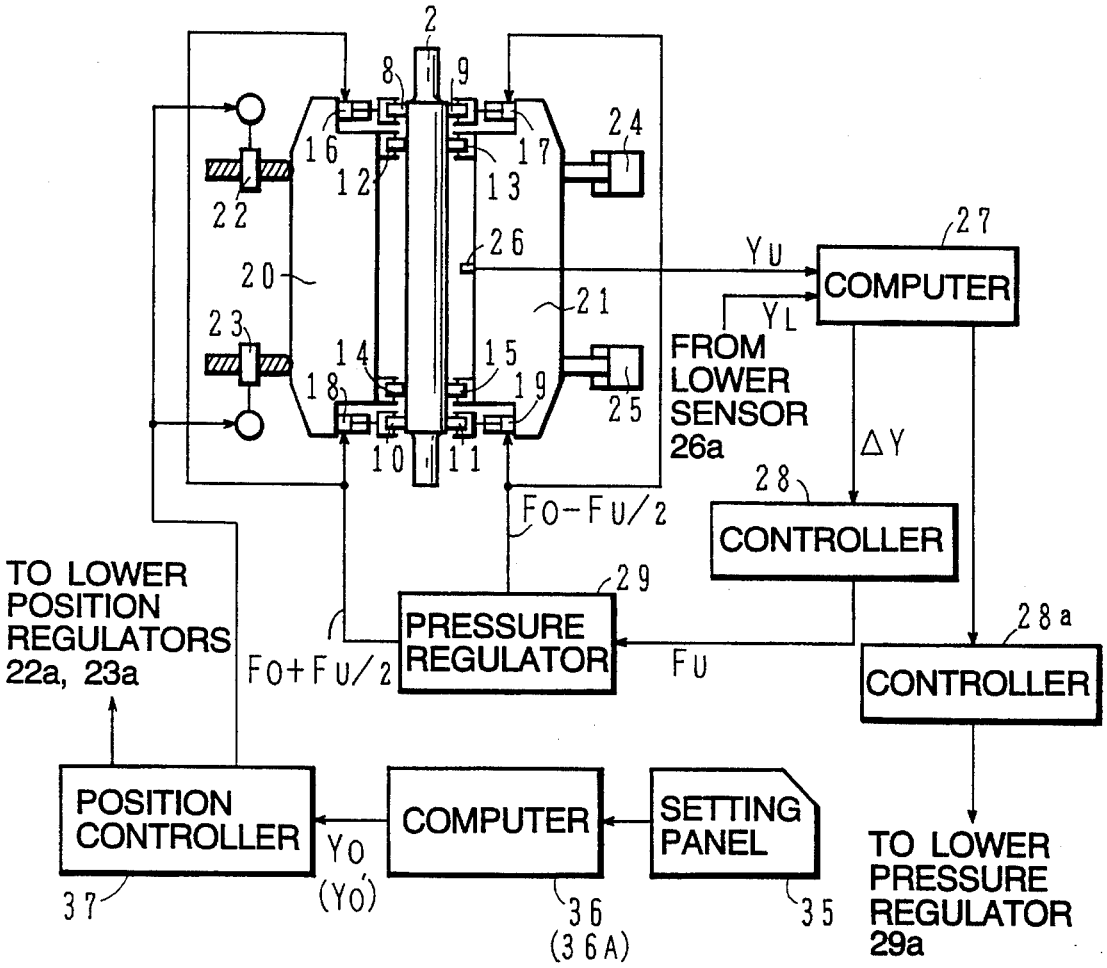
FIG. 1 is a schematic view of a rolling mill according to one embodiment of the present invention.
Figure 2:
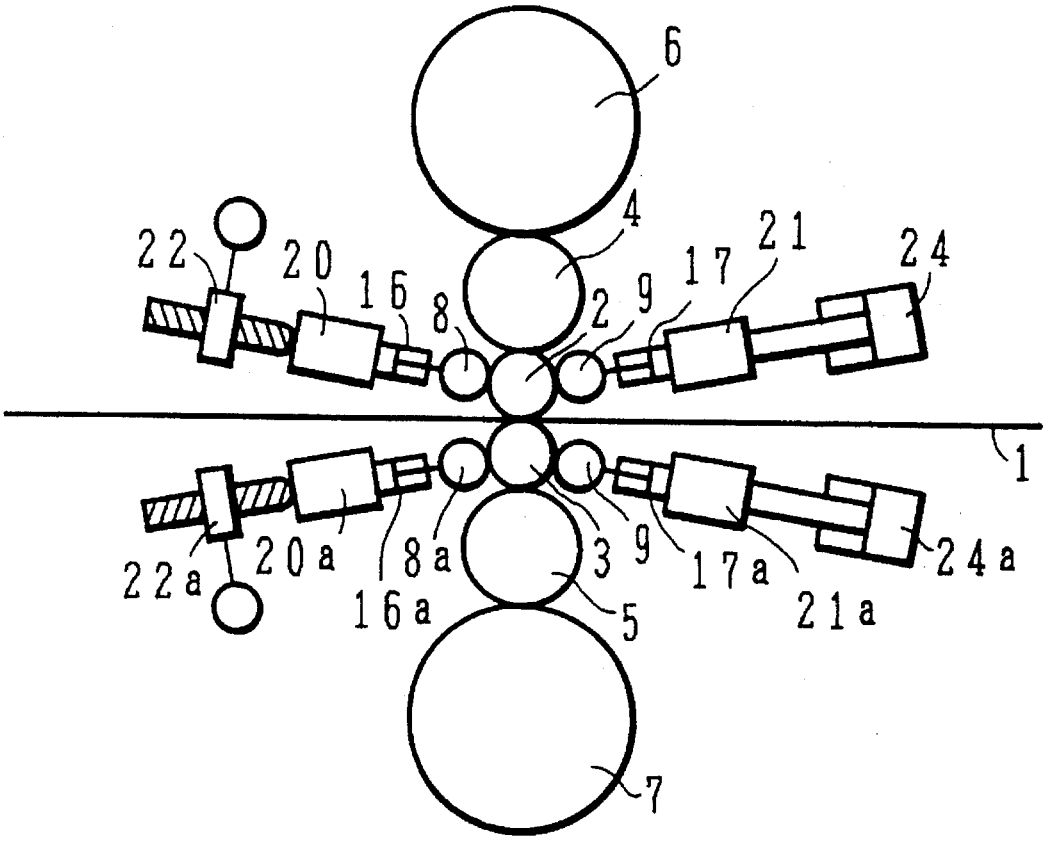
FIG. 2 is a schematic front view of the rolling mill shown in FIG. 1.

FIG. 1 shows one embodiment of the present invention. FIG. 2 shows the UC-1F mill as one example of a rolling mill to which the present invention is applied. Referring to FIG. 2, a strip 1 is being by upper and lower work rolls 2, 3. Reference numerals 4, 5 denote intermediate rolls axially movable and 6, 7 denote backup rolls. FIG. 1 corresponds to part of the upper work roll 2 in FIG. 2 as viewed from above. The work roll 2 is horizontally supported by a total of eight support rolls 8 to 15 which are installed on the entry and delivery sides outwardly of the passage of strips having a maximum width, thereby preventing a deflection of the work roll in a horizontal plane. Of these support rolls, the four outer support rolls 8 to 11 are attached to beams 20, 21 through respective hydraulic cylinders 16 to 19, and the four inner support rolls 12 to 15 are directly attached to the beams 20, 21. In other words, the eight support rolls 8 to 15 and the beams 20, 21 jointly make up horizontal support means for horizontally supporting both end portions of a work roll barrel exceeding the maximum width of the strip 1 outwardly, while the four support rolls 12 to 15 and the hydraulic cylinders 16 to 19 jointly make up horizontal bending means for acting upon both end portions of the work roll barrel exceeding the maximum width of the strip 1 outwardly to bend the work roll 2 horizontally. The beam 20 is movable in the longitudinal direction (rolling direction) of the strip 1 by screw type offset position regulators 22, 23 for setting the offset position of the work roll 2 before the start of rolling. On the other hand, the beam 21 is pressed against the work roll 2 by the cylinders 24, 25 under a predetermined pressure.

The lower work roll 3 is of the same structure as the upper work roll 2. In the figures, components associated with the lower work roll 3 are denoted by suffixing a to each of the same reference numerals denoting the counterparts associated with-the upper work roll 2. While a portion of the components associated with the lower work roll 3 is not shown, those components will be described below using only the reference numerals suffixed with a's.

The beam 21 is provided with non-contact displacement gauges 26, **26*a* as means for measuring horizontal deflections of the upper and lower work rolls 2, 3 during the rolling. Further, a computer 27, horizontal bending controllers 28, 28*a* and pressure regulators 29, 29*a* for the upper and lower work rolls are provided as horizontal deflection control means for controlling the hydraulic cylinders 16 to 19, 16*a* to 19*a*, as the horizontal bending means for the upper and lower work rolls 2, 3, so that the difference between a measured value for the upper work roll 2 and a measured value for the lower work roll 3 is kept within a predetermined range. Alternatively, the displacement gauge and the horizontal control means may be provided with only one of the upper and lower work rolls so as to control only one group of the hydraulic cylinders 16 to 19 or 16***a* to 19*a*.

Also, a setting panel 35, a computer 36 and a position controller 37 are provided as means for setting the upper and lower work rolls 2, 3 to respective predetermined offset positions which are determined by rolling conditions such as the strip thickness, strip width and rolling load, and at which the strip shape is not affected by the horizontal deflections of the work rolls 2, 3. The offset positions are set before the start of rolling and are held fixed during the rolling. Under this condition, the horizontal deflection control is performed by the horizontal bending means.

Figure 3:
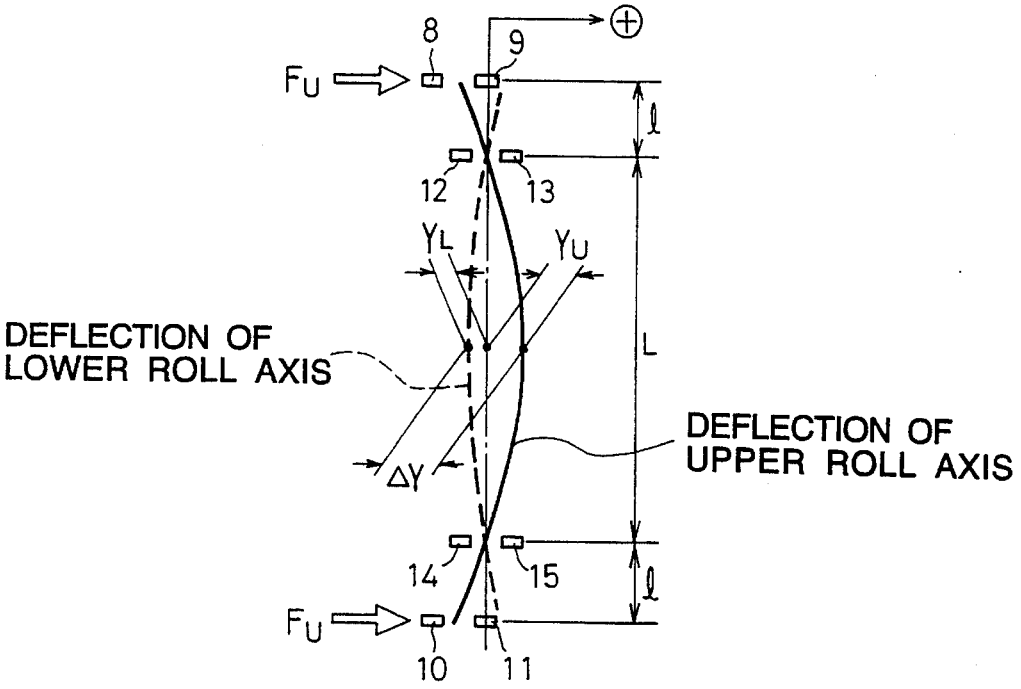
FIG. 3 is an illustration showing one example of a condition wherein axes of upper and lower work rolls are horizontally deflected.

Details of the horizontal deflection control by the horizontal bending means will be described below. FIG. 3 illustrates one example of deflections of axes of the upper and lower work rolls. It is assumed here that the right-hand direction as viewed in the figure represents a positive direction, and a force applied rightward is a positive force. First, a horizontal deflection YU of the upper work roll 2 is measured by the non-contact displacement gauge 26. Similarly, a horizontal deflection YL of the lower work roll 3 is measured by the non-contact displacement gauge 26*a* (not shown). These measured values are input to the computer 27. The computer 27 selects one of YU and YL which has a smaller absolute value, i.e., which is closer to 0, and also calculates the difference ΔY between the upper and lower deflections. When ΔY exceeds a certain threshold ξ, the following control is performed. Assuming now that the absolute value of YL is smaller as shown in FIG. 3, the control required is to reduce the horizontal deflection YU of the upper work roll 2 by ΔY so as to be coincident with YL. To this end, bending forces FU are applied to the upper work roll as shown in FIG. 3. Therefore, the computer 27 calculates ΔY from the following Equation (1) and outputs it to the horizontal bending controller 28 for the upper work roll:

$$\Delta Y=YU-YL \tag{1}$$

The horizontal bending controller 28 calculates FU and supplies it to the pressure regulator 29. The necessary bending force FU is determined from;

$$FU=8E\cdot I\cdot\Delta Y/(l\cdot 1^2) \tag{2}$$

where E is the Young's modulus of the work roll, I is the second moment of area, L is the distance between the inner support rolls 12, 14, and 1 is the distance between the outer support rolls 8, 10. If the cylinder pressure is made 0, the work roll and the support roll would repeatedly contact with or depart away from each other, which may cause scratches on the rolls. In general, therefore, the pressure of the left-hand cylinder is given corresponding to FO+FU/2 and the pressure of the right-hand cylinder is given corresponding to FO–FU/2. Here, FO is a constant of arbitrary value. Thus, the pressure regulator 29 is operated so that the cylinders 16, 18 produce the force FO +FU/2 and the cylinders 17, 19 produce the force FO–FU/2. When the horizontal deflection of the upper work roll is closer to 0 and the horizontal bending is to be applied to the lower work roll, the control is performed as follows. Instead of the above Equation (1), the computer 27 calculates ΔY from;

$$\Delta Y=YL-YU \tag{3}$$

and supplies it to the horizontal bending controller 28*a* for the lower work roll. The ending controller 28*a* determines the necessary bending force from;

$$FL=8E\cdot I\cdot\Delta Y/(l\cdot 1^2) \tag{4}$$

A subsequent flow of the control is the same as in the above control.

Figure 4:
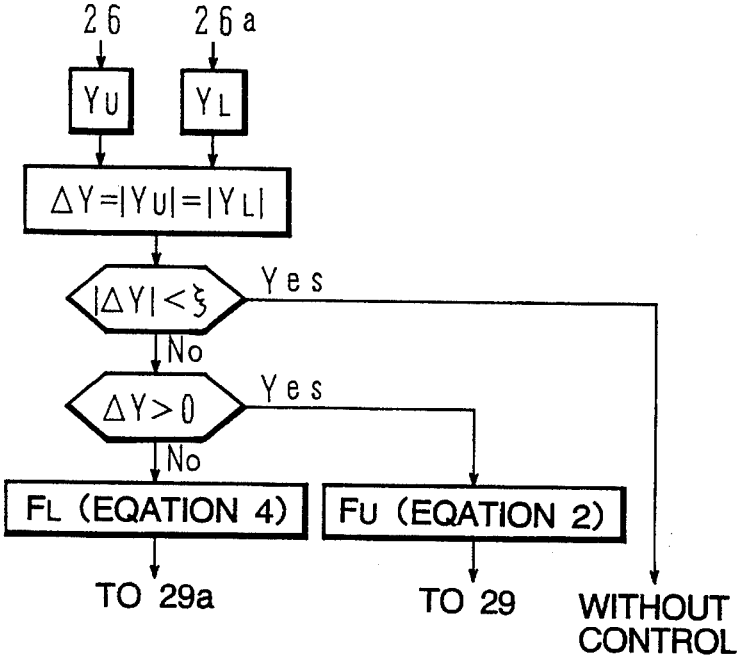
FIG. 4 is a flowchart for explaining a flow of horizontal deflection control by horizontal bending means.

FIG. 4 shows, in the form of a flowchart, the process carried out by the computer 27 and the controllers 28, 28*a*. Incidentally, the threshold ξ is approximately 10 μm, for example, on condition that each work roll has a diameter of 55 mm and an axial effective rolling length of 650 mm.

With the above horizontal deflection control by the horizontal bending means, the difference between the deflection amounts of the upper and lower work rolls 2, 3 is controlled to become smaller, and the upper and lower work rolls 2, 3 are prevented from deflecting in opposite directions.

Figure 5:
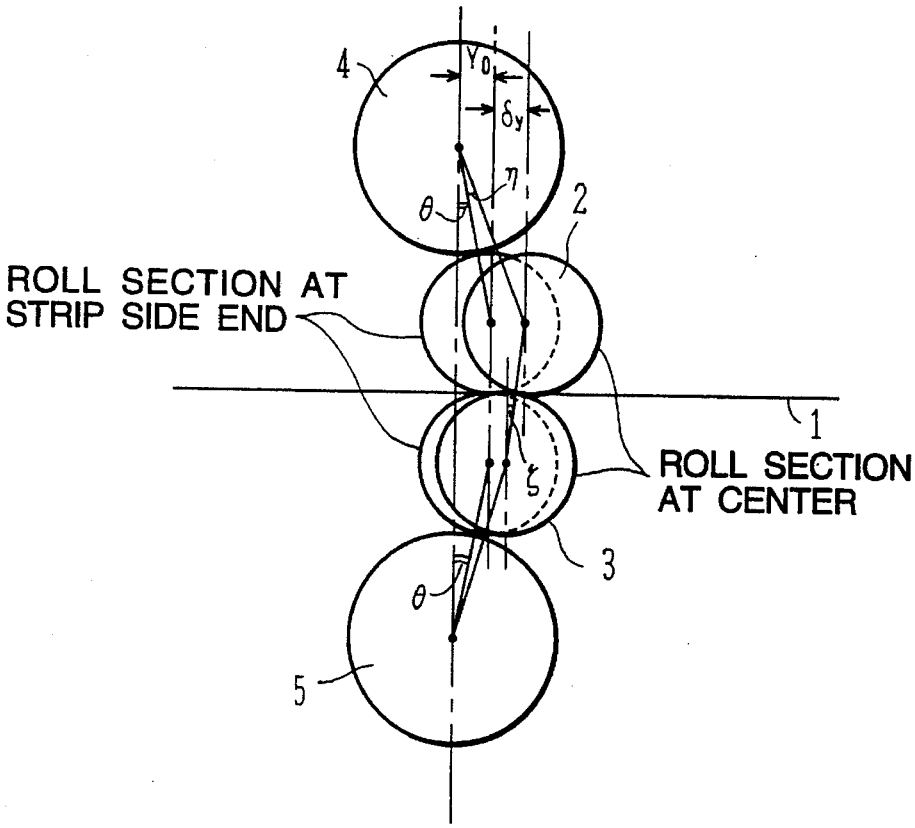
FIG. 5 is an illustration showing horizontal forces exerted on the work rolls.
Figure 6:
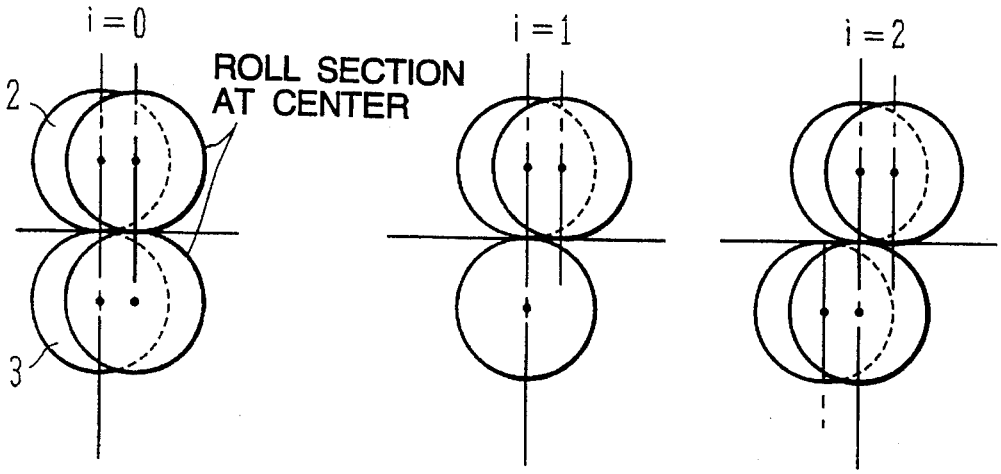
FIG. 6 is an illustration showing deflection modes of the upper and lower work rolls.

A description will now be made of why a reduction in the difference between the deflection amounts of the upper and lower work rolls is effective for stable rolling. A horizontal force H acting upon the work roll so as to cause a horizontal deflection is given by;

$$H=HO+HY \tag{5}$$

where HO is a horizontal force acting in the absence of the horizontal deflection and HY is an increment of the horizontal force due to the deflection. HO and HY are given by:

$$HO=P\theta-\tau+(Tf-Tb)/2 \tag{6}$$

$$HY=P(2/3)(\eta+\zeta) \tag{7}$$

where P is the rolling load, τ is a tangential force due to the driving force, Tb, Tf are respectively back/front tensions, and 2/3 is the ratio of average deflection to maximum deflection at the roll center. Also, θ, η and z are angles shown in FIG. 5 and given by;

$$\theta=2YO/(DW+DI) \tag{8}$$

$$\eta=2\delta Y/(DW+DI) \tag{9}$$

$$\zeta=i\cdot\delta Y/DW \tag{10}$$

where YO is the offset amount of the work roll, DW, DI are respectively the diameters of the work roll and the intermediate roll, δY is the horizontal deflection at the roll center, and i is the coefficient determined depending upon horizontal deflection modes of the upper and lower work rolls. As will be seen from one example shown in FIG. 6, the coefficient i is 0 when the upper and lower deflections are coincident with each other, is 2 when the work rolls are deflected in opposite directions in the same amount, and takes a value between 0 and 2 varying in proportion when the work rolls are in an intermediate condition. On the other hand, assuming the bending rigidity to be A, the relationship between the horizontal deflection δY and the horizontal force H is expressed by:

$$\delta Y=H/A \tag{11}$$

From the above Equations, the horizontal deflection δY is given by:

$$\delta Y=HO/(A-2/3B\cdot P) \tag{12}$$

$$B=2/(DW+DI)+i/DW \tag{13}$$

In the Equation (12), if a denominator is 0, the horizontal deflection δY is infinite and P at this time provides a limit maximum rolling load Pmax. Accordingly, $$Pmax=3A/2B \tag{14}$$

is obtained.

As will be apparent from the above result, to increase the limit maximum rolling load, B must be made smaller on condition that the bending rigidity A of the work roll and the roll diameter are constant. Since the Equation (13) includes only the coefficient i as a variable, it is required to always keep the coefficient i small for reducing B. If the coefficient i is 0, B is minimized. The coefficient i being 0 means that the upper and lower horizontal deflections are coincident with each other.

Consequently, by making control so that the difference between the deflection amounts of the upper and lower work rolls 2, 3 is kept small, the limit maximum rolling load is increased and the difference between the deflection amounts is prevented from being amplified acceleratingly even if the rolling load is increased. As a result, the stable rolling is achieved.

The setting of the offset positions of the work rolls prior to the start of rolling will now be described in detail. First, a description will be made of the predetermined offset position which is determined by rolling conditions such as the strip thickness, strip width and rolling load, and at which the strip shape is not affected by the horizontal deflection of each of the work rolls 2, 3.

Figure 7:
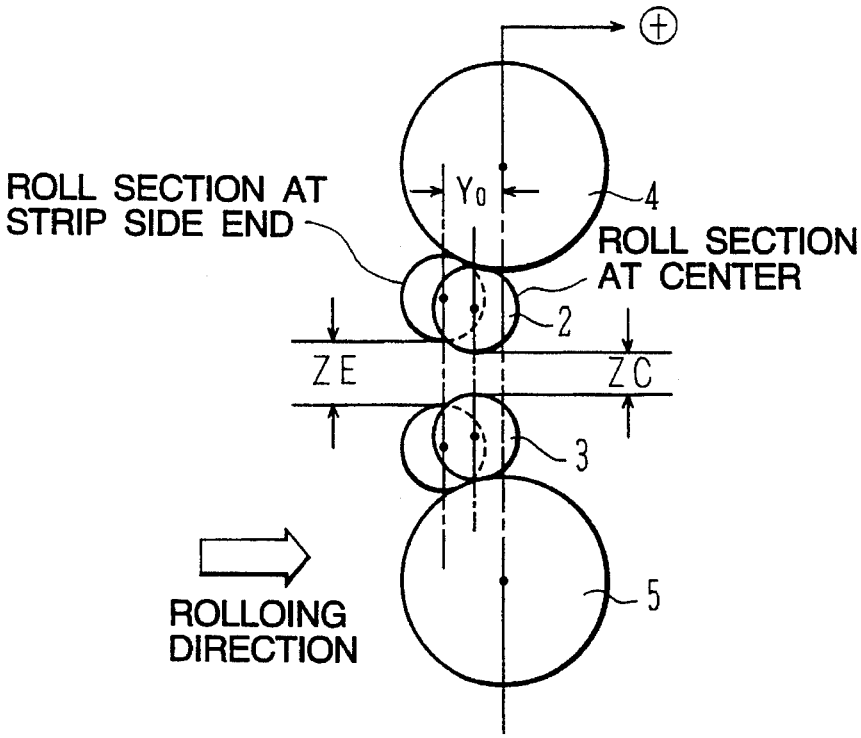
FIG. 7 is an illustration for explaining the so-called vertical effect that a vertical roll gap profile is geometrically changed with horizontal deflections of the work rolls.

There are two kinds of influences upon the strip shape by horizontal deflections of work rolls; i.e., variations in the strip shape due to geometrical change in the vertical gap profile between the rolls (called a vertical effect) and a direct influence due to the horizontal deflection itself (called a horizontal effect). To describe these effects in detail with reference to FIG. 7 and FIG. 8 as a plan view of FIG. 7, when the roll centers come closer to the mill center upon the occurrence of horizontal deflections from a condition that the work rolls 2, 3 are offset with respect to the intermediate rolls 4, 5 supporting them, the center gap between the upper and lower work rolls is reduced correspondingly. Therefore, a central portion of the strip 1 is rolled into a thinner plate and hence has a centrally elongated shape. This is the vertical effect conventionally known. Assuming now that the horizontal deflection of the work roll with the roll position corresponding to the strip side end as a reference is $\delta Y$ as above, the resultant difference $\delta Z$ between a gap ZC between the upper and lower work rolls at the center and a gap ZE therebetween at the strip side end is given by;

$$\delta Z \approx 4YO/(DW+DI)\cdot\delta Y \tag{15}$$

where YO is the offset amount of the work roll at the position corresponding to the strip side end as a reference, the offset amount being positive when the work roll is offset toward the delivery side, DW is the diameter of the work roll, and DI is the diameter of the intermediate roll. The strip shape is represented by the difference $\Delta\epsilon$ between an elongation at the center and an elongation at the side end. Thus, in the case of central elongation, $\Delta\epsilon$ is positive. The elongation difference $\Delta\epsilon$, i.e., shape variation $\Delta\epsilon Z$, due to the vertical effect is substantially proportional to $\delta Z$ and, given a proportional constant as $\gamma Z$, is expressed by:

$$\Delta\epsilon Z \approx -\gamma Z\cdot\delta Z/h = -4\gamma Z\cdot YO/(DW+DI)/h\cdot\delta Y \tag{16}$$

Thus, the shape variation is substantially proportional to the horizontal deflection. In the Equation (16), h is the strip thickness on the delivery side and $\gamma Z$ can also be said as an influence coefficient of the vertical effect. When YO is negative and $\delta Y$ is positive as in the case of FIG. 7, the strip shape is centrally elongated and $\Delta\epsilon$ is positive. Therefore, $\gamma Z$ takes a positive value.

On the other hand, the above-described horizontal effect has been confirmed from the experiments, and resultant shape variation $\Delta\epsilon Y$ is also substantially proportional to the horizontal deflection $\delta Y$. Thus, given an influence coefficient of the horizontal effect as $\gamma Y$, the following equation is obtained:

$$\Delta\epsilon Y \approx \gamma Y\cdot\delta Y \tag{17}$$

Figure 8:
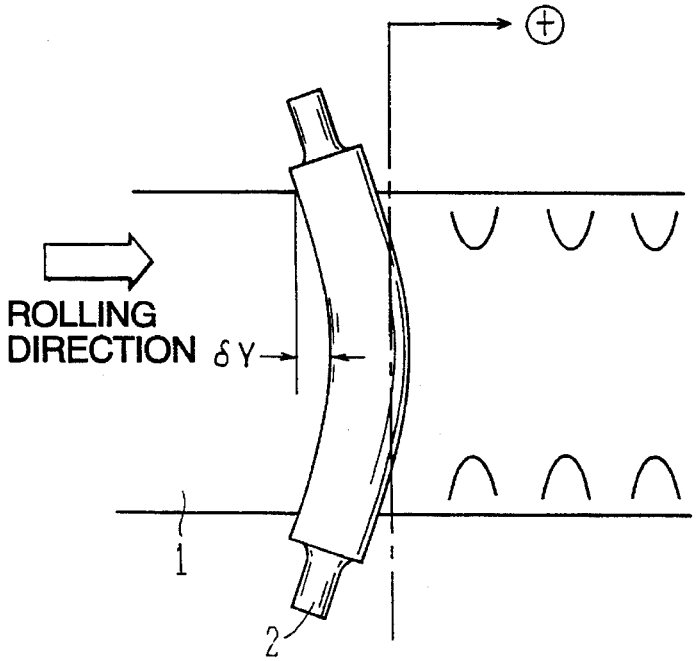
FIG. 8 is an illustration showing the horizontal effect due to the horizontal deflections of the work rolls, and it is also a plan view of FIG. 7.

More specifically, as shown in FIG. 8, when $\delta Y$ is positive (meaning a condition that the strip center is relatively advanced in the rolling direction), the strip shape is elongated at the side ends ($\Delta\epsilon$ being negative). Therefore, $\gamma Y$ also takes a negative value.

Figure 9:
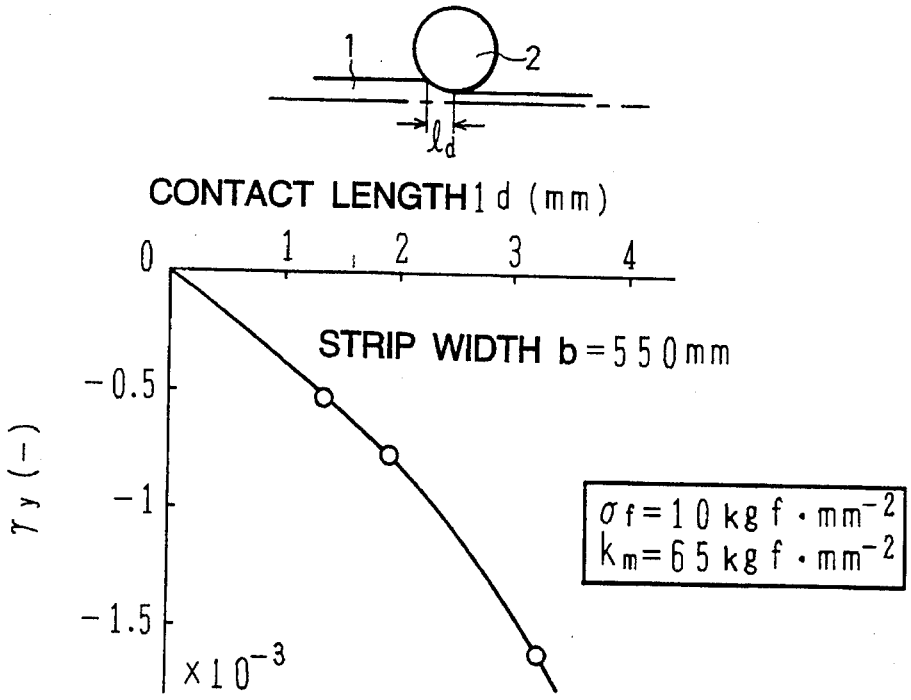
FIG. 9 is a graph showing results of measuring the relationship between an influence coefficient $\gamma Y$ of the horizontal effect and a roll-to-strip contact length.
Figure 10:
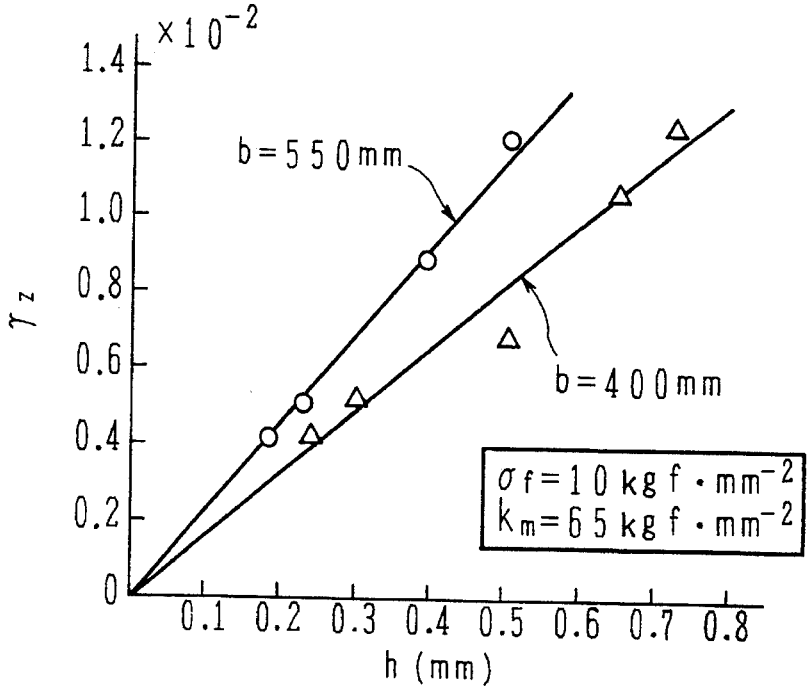
FIG. 10 is a graph showing results of measuring the relationship between an influence coefficient $\gamma Z$ of the vertical effect and a strip thickness on the delivery side.

Therefore, by setting the shape variation due to the vertical effect and the shape variation due to the horizontal effect so as to cancel each other, no shape variations are eventually produced even if the work roll is horizontally deflected. From the relationship of;

$$\Delta\epsilon Z + \Delta\epsilon Y = 0 \tag{18}$$

the offset amount YO of the work roll required to realize such a canceling is given by;

$$YO = \gamma Y\cdot h(DW+DI)/4\gamma Z \tag{19}$$

where $\gamma Y$ and $\gamma Z$ are experimentally determined. By way of example, FIG. 9 shows results of $\gamma Y$ measured on a rolling mill in which the diameter of the work roll is 60 mm, the diameter of the intermediate roll is 190 mm, the diameter of the backup roll is 460 mm, and the length of the roll barrel is 650 mm, and FIG. 10 shows results of $\gamma Z$ measured thereon. In these figures, $\sigma f$ is the front tension acting upon the strip on the delivery side of the work rolls, km is resistance of the strip against deformation, and b is the strip width. From a result of the experiments, it has been confirmed that $\gamma Y$ can be expressed using the contact length ld between the work roll and the strip as shown in FIG. 9. Also, $\gamma Z$ is substantially proportional to the strip thickness h on the delivery side. Therefore, if the rolling conditions such as the strip width, strip thickness on each of the entry and delivery sides, and rolling load are known, it is possible to determine $\gamma Y$, $\gamma Z$ from FIGS. 9 and 10 and then to determines the optimum offset amount YO from the Equation (19).

The means of setting the work roll offset position in this embodiment is to calculate the optimum offset amount YO based on the principles described above, and to set the upper and lower work rolls 2, 3 to the corresponding offset positions. More specifically, the setting panel 35 stores the rolling conditions about a strip to be next rolled. The computer 36 takes in those rolling conditions and then calculates the optimum offset amount YO. Before the start of rolling, the calculated optimum offset amount YO is supplied to the position controller 37 which controls the offset position regulators 22, 23 and **22*a*, 23*a* so that the upper and lower work rolls 2, 3** are set to the desired offset positions.

Figure 11:
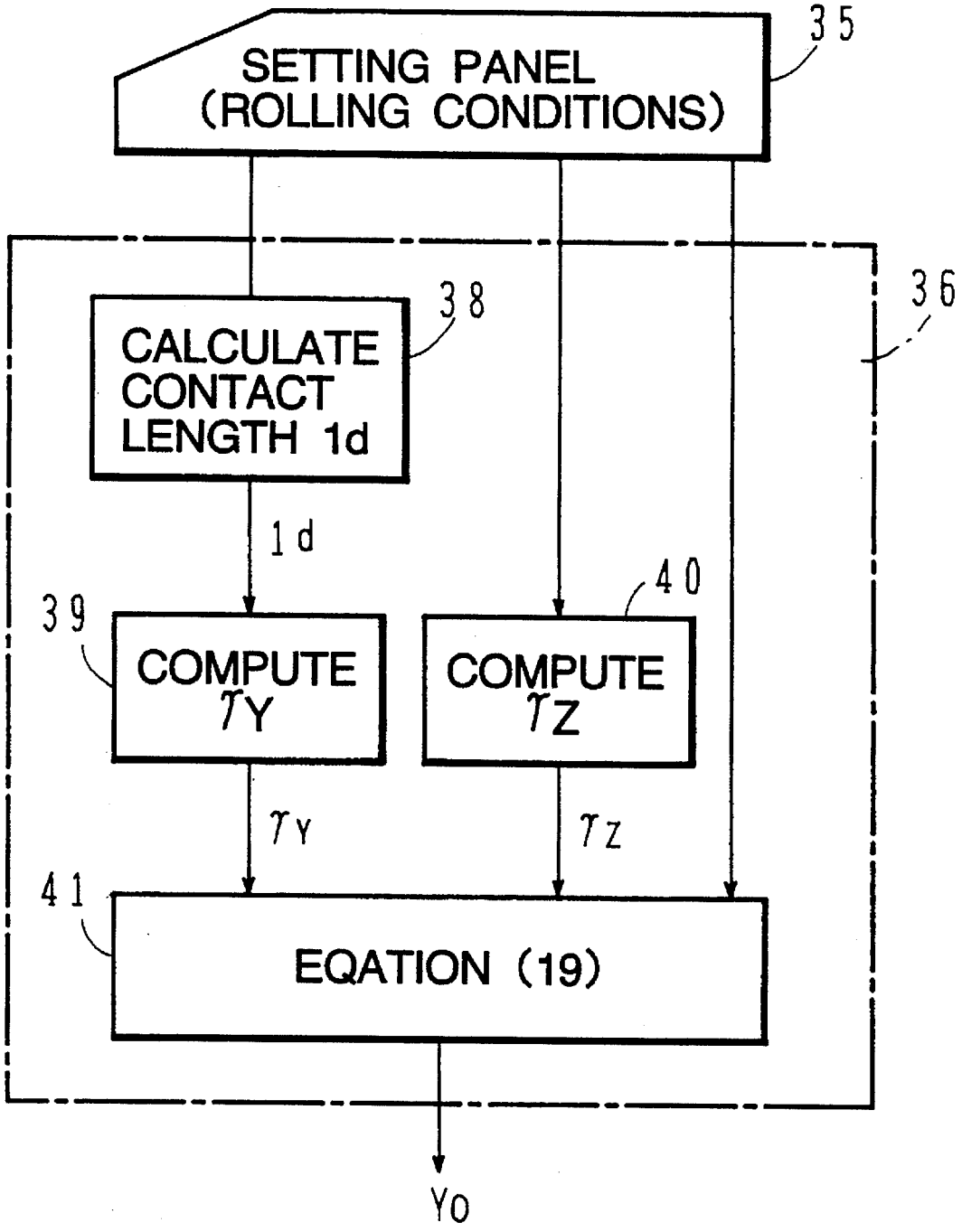
FIG. 11 is a flowchart showing a calculation flow executed by offset position setting means in a computer.

FIG. 11 shows a flow of calculations carried out in the computer 36. First, in a calculation block 38, the contact length ld is calculated by the well-known method. Then, $\gamma Y$ is determined from the relationship of FIG. 9 in a calculation block 39. On the other hand, $\gamma Z$ is determined from the relationship of FIG. 10 in a calculation block 40. Finally, the maximum offset amount YO is calculated using the Equation (19) in a calculation block 41.

Figure 12:
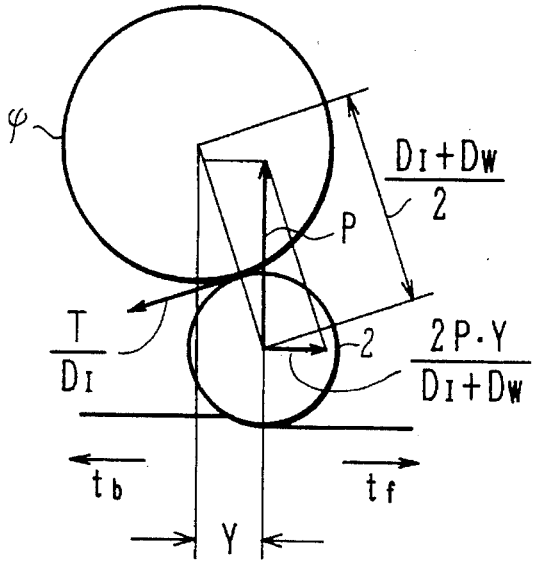
FIG. 12 is an illustration showing forces exerted to the work roll.

By modifying the calculation flow of FIG. 11, the above principles are also applicable to another offset position setting method. For example, an offset amount YO' can also be calculated which is determined depending upon the rolling load P, the total torque T on the upper and lower sides, and the back/front tensions tb, tf, and at which the horizontal force exerted on the work roll becomes 0 as previously described. FIG. 12 illustrates respective forces exerted on the work roll. From FIG. 12, the horizontal force Q is expressed by:

$$Q=T/D1-2P\cdot Y/(DI+DW)+tb-tf \quad (20)$$

Here, YO' is given as the offset amount Y at which Q becomes 0 and hence is expressed by:

$$YO'=(DI+DW)(T/DI+tb-tf)/2P \quad (21)$$

Figure 13:
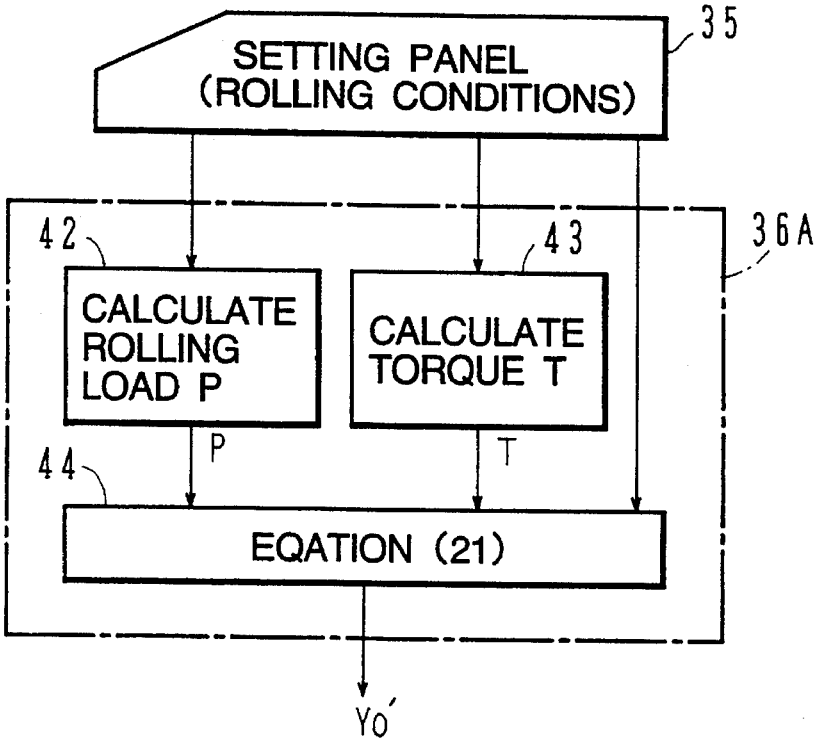
FIG. 13 is a flowchart showing a calculation flow executed by another offset position setting means in the computer.

In this case, a flow of calculations carried out in a computer 36A is as shown in FIG. 13. The rolling load P is calculated by the known method in a calculation block 42, and the total torque T is calculated by the known method in a calculation block 43. Finally, the offset amount YO' is calculated using the Equation (21) in a calculation block 44 and then supplied to the offset position controller 37.

This embodiment can provide the advantages below. First, the difference between the deflection amounts of the upper and lower work rolls or the oppositely deflected condition of the work rolls will not be amplified acceleratingly, and stable rolling of high-quality strips with good shape or flatness can be achieved. This also contributes to an improvement in the yield.

Further, the resultant stable rolling enables the diameter of the work roll to be reduced as compared with the prior art. The experiments have proved that the diameter of the work roll can be made about 20% smaller than would be the case of not employing the above embodiment.

At the same time, the rolling load can be increased under the stable rolling. The experiments have proved that the present mill can endure the rolling load about 2.5 times as great as the case of not employing the above embodiment.

In addition, as the result of the smaller diameter of the work roll and the greater rolling load, a reduction rate per pass is increased and hence productivity is improved significantly.

Another embodiment of the present invention will be described with reference to FIGS. 14 and 15. This embodiment is aimed to remedy a transversely asymmetrical defection.

Figure 14:
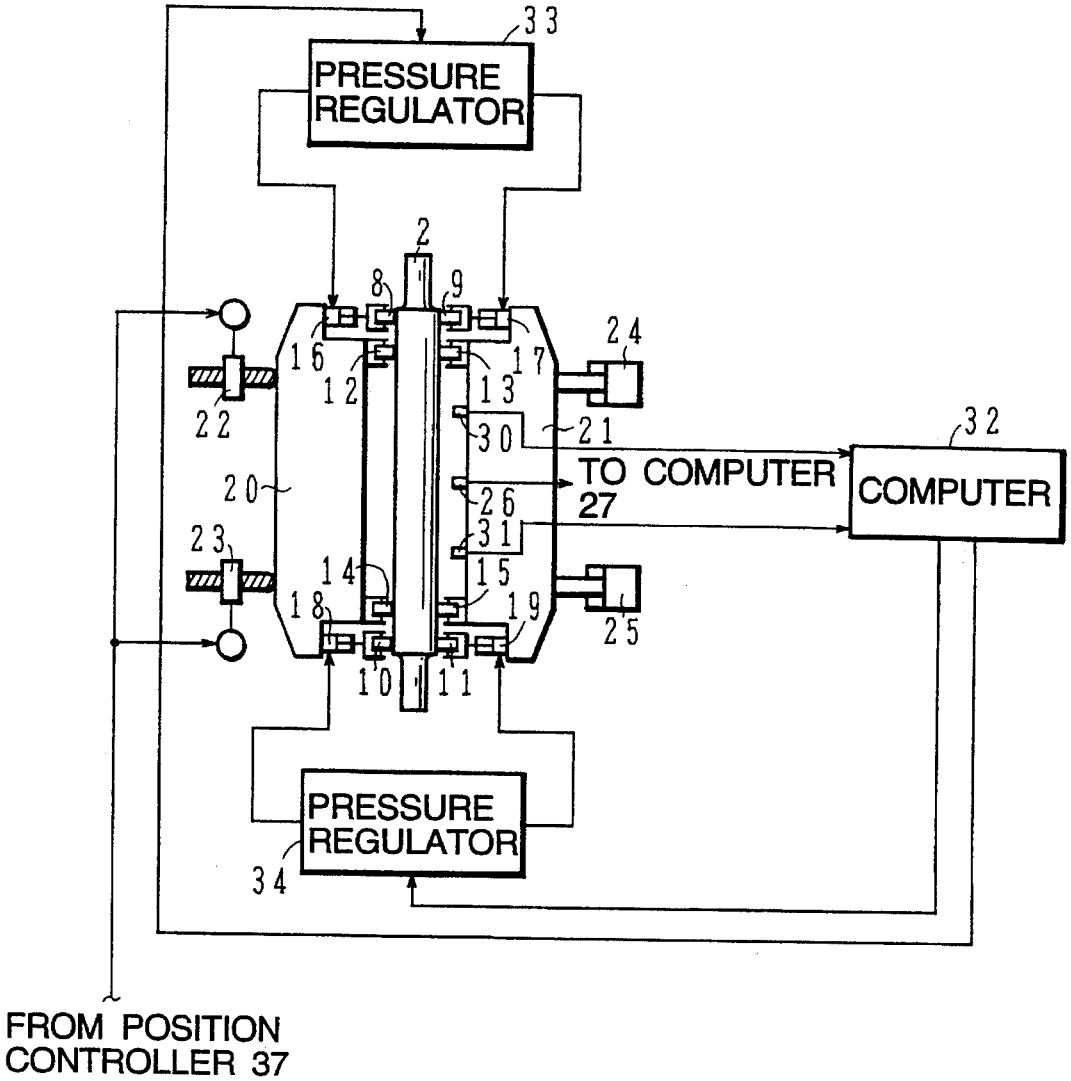
FIG. 14 is a schematic view of a rolling mill according to another embodiment of the present invention.

As shown in FIG. 14, besides the mill construction of the embodiment shown in FIG. 1, a rolling mill of this embodiment includes as means for measuring horizontal deflections of the work rolls at two axially spaced positions thereon during the rolling, non-contact displacement gauges 30, 31 which are each identical to the non-contact displacement gauge 26 and are provided on both sides of the gauge 26. Further, a computer 32 and pressure regulators 33, 34 are provided as means for controlling the hydraulic cylinders 16 to 19, as the work roll horizontally bending means, so that the difference between values measured at the two axially spaced positions is kept within a predetermined range. Similar measuring means and control means, though not shown, are also provided for the lower work roll. Alternatively, those means may be provided for only one of the upper and lower work rolls.

Figure 15:
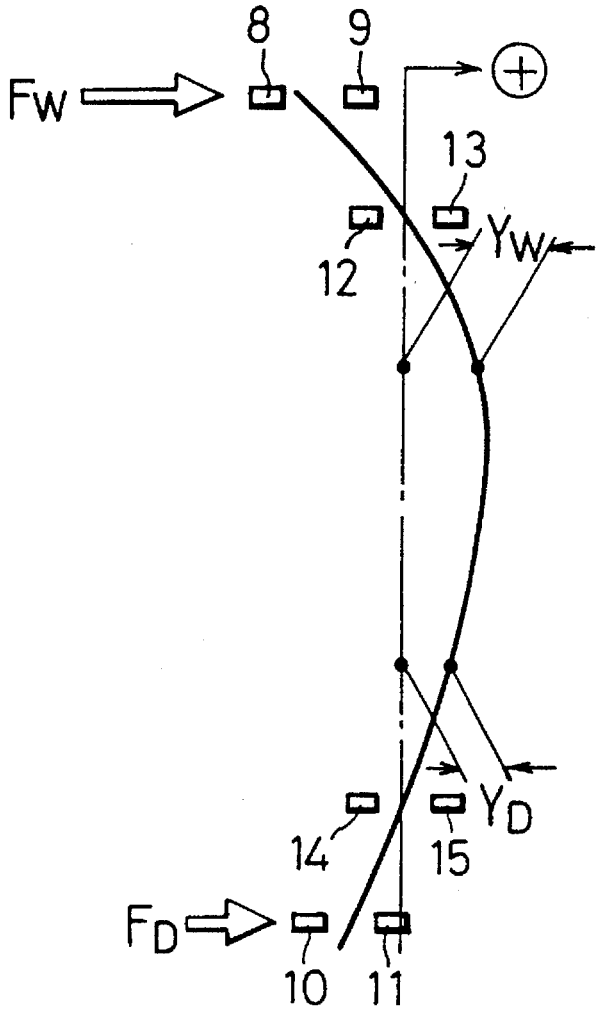
FIG. 15 is an illustration showing one example of a condition wherein axes of upper and lower work rolls are horizontally deflected in another embodiment.

FIG. 15 shows one example of a transversely asymmetrical defection of the roll axis to be remedied. The displacement gauge 30 detects a horizontal deflection YW on the working side and the displacement gauge 31 detects a horizontal deflection YD on the driving side, YW and YD being supplied to the computer 32. The computer 32 executes calculations as follows. When the difference between YW and YD is not greater than an allowable value, no additional control is performed. When YW is greater than YD as shown in FIG. 15, it is required to increase a bending force FW on the working side and a bending force FD on the driving side. In the simplest way, therefore, the bending forces are given by;

$$FW=\alpha_1\cdot YW \quad (22)$$

$$FD=\alpha_1\cdot YD \quad (23)$$

where $\alpha_1$ is a proportional constant which is properly selected so that the control will not be subject to hunting. These values are supplied to the pressure regulators 33, 34 provided respectively on the working side and the driving side. Subsequently, respective cylinder pressures are set in the same manner as in the embodiment of FIG. 1.

The method of applying the bending force may be modified as follows. Only one of the cylinders on the working or driving side may be controlled. In this case, it is possible to, for example, apply ΔF given below to the working side and 0 to the driving side;

$$\Delta F=FW-FD=\alpha_1(YW-YD) \quad (24)$$

As an alternative, ΔF may be divided into a bending force change ΔFW on the working side and a bending force change ΔFD on the driving side as follows:

$$\Delta FW=\Delta F/2 \quad (25)$$

$$\Delta FD=-\Delta F/2 \quad (26)$$

While this embodiment is arranged so as to add the measure, shown in FIG. 14, for remedying the transversely asymmetrical deflection to the entire construction of the embodiment shown FIG. 1 for the purpose of eliminating both the vertically and transversely asymmetrical deflections, the measure shown in FIG. 14 may be added to rolling mills which include no construction for remedying the vertical asymmetrical deflection (i.e., no horizontal deflection control for reducing the difference between the deflection amounts of the upper and lower work rolls), to thereby eliminate only the transversely asymmetrical deflection.

According to this embodiment, the horizontal deflection becomes symmetrical, the strip is prevented from being rolled into a complicated shape, and rolling of high-quality strips with good shape or flatness can be achieved. Because of including the entire construction of the embodiment shown FIG. 1 in a combined manner, it is further possible to achieve stable rolling of high-quality strips with good shape or flatness and hence to improve the yield.

Still another embodiment of the present invention will be described with reference to FIG. 16. This embodiment is aimed to control the offset positions of the work rolls so that the horizontal force exerted on each roll is kept at 0 during the rolling.

Figure 16:
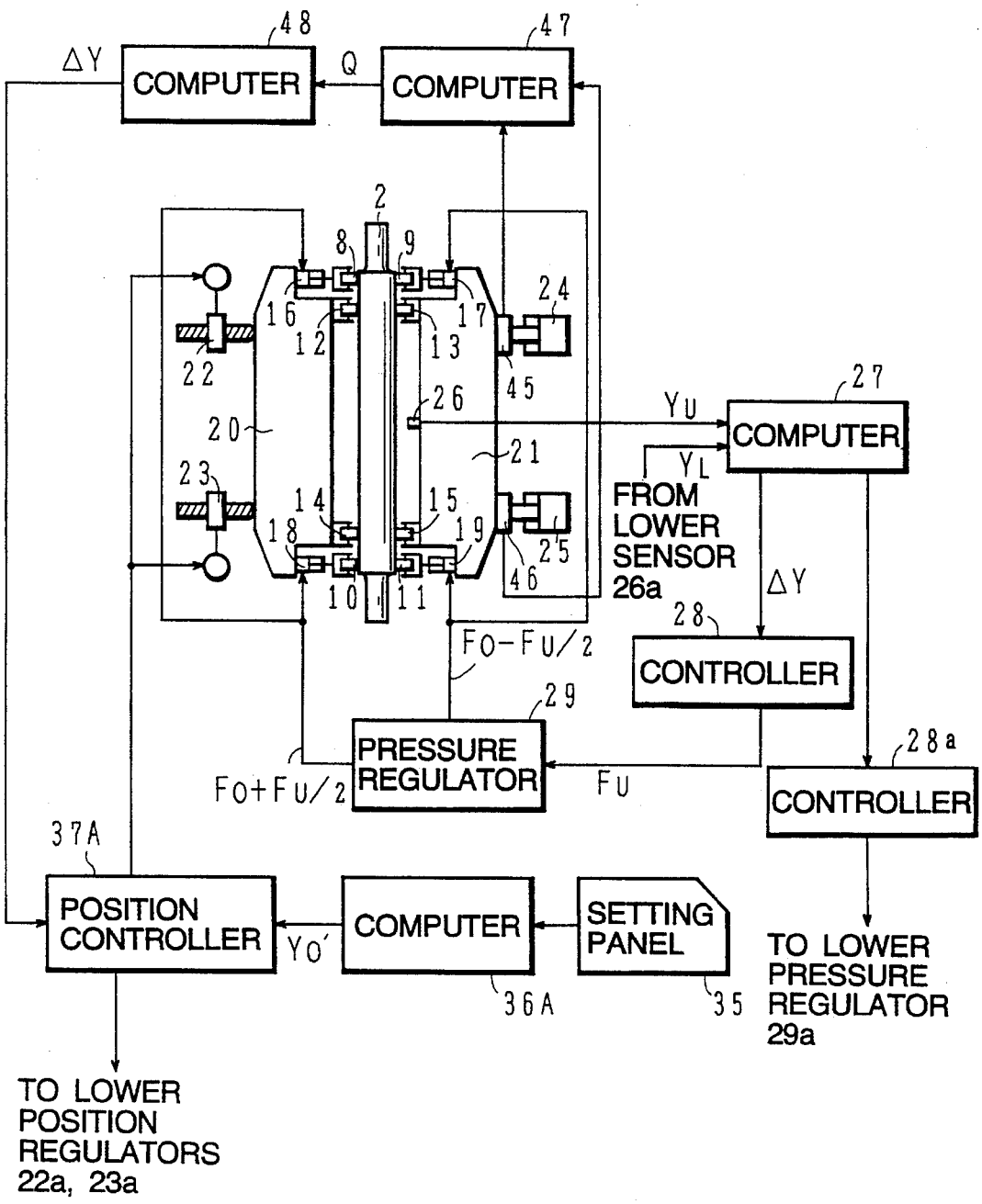
FIG. 16 is a schematic view of a rolling mill according to still another embodiment of the present invention.

As shown in FIG. 16, besides the mill construction of the embodiment shown in FIG. 1, a rolling mill of this embodiment includes as means for measuring the horizontal force exerted on at least one of the upper and lower work rolls during the rolling, load cells 45, 46 disposed between the beam 21 and the cylinders 24, 25 for detecting respective horizontal forces exerted on the upper work roll 2 and a computer 47 for summing values measured by the load cells 45, 46 to determine the horizontal force Q. Further, a computer 48 and a position controller 37A for the offset position regulators 22, 23 and 22*a*, 23*a* are provided as means for regulating the offset positions of upper and lower work rolls so that the measured value of the horizontal force Q is kept not greater than a predetermined value.

Before the start of rolling, as previously described with reference to FIGS. 12 and 13, the offset amount YO' with which the horizontal forces exerted on the upper and lower work rolls 2, 3 become 0 is determined by the computer 36A, and the offset position regulators 22, 23 and 22*a*, 23*a* are driven by the position controller 37A to set the offset positions of the upper and lower work rolls.

During the rolling, the respective horizontal forces exerted on the upper work roll 2 are detected by the lead cells 45, 46 and are summed by the computer 47 to determine the horizontal force Q. Here, the horizontal force exerted to the left in FIG. 12 is given with a positive sign. So that the horizontal force is kept at 0, it is required to increase the offset amount Y in FIG. 12 (i.e., to move the work roll rightward) if the horizontal force 0 is positive, and to reduce the offset amount Y (i.e., to move the work roll leftward) if it is negative. Therefore, the computer 48 calculates an offset change ΔY using the following equation based on the detected Q and supplies it to the offset position controller 37A for regulating the offset positions of the upper and lower work rolls 2, 3;

$$\Delta Y=\alpha_2 Q \tag{27}$$

where $\alpha_2$ is a control gain which is properly selected so that the control will not be subject to hunting. In the Equation (27), if Q is positive, ΔY is also positive and the offset amount Y is increased. If Q is negative, the control is performed conversely. As a result, the upperside horizontal force is always controlled to be kept in the vicinity of 0, and hence the horizontal deflection of the upper work roll 2 is also kept at approximately 0. When the rolling conditions are different between the upper and lower sides, the horizontal force is not always kept at 0 on the lower side and a slight horizontal deflection may occur. On the other hand, since the upper and lower work rolls 2, 3 are controlled with the above-described horizontal deflection control of the invention so that the horizontal deflections on the upper and lower sides become 0, the horizontal deflection of the upper and lower work rolls are eventually kept at 0.

According to this embodiment, the offset positions of the work rolls are regulated even during the rolling so that the horizontal force is kept at 0 and, therefore, the horizontal deflection control is performed in a more reliable manner during the rolling. Accordingly, stable rolling of high-quality strips with better shape or flatness can be achieved.

Figure 17:
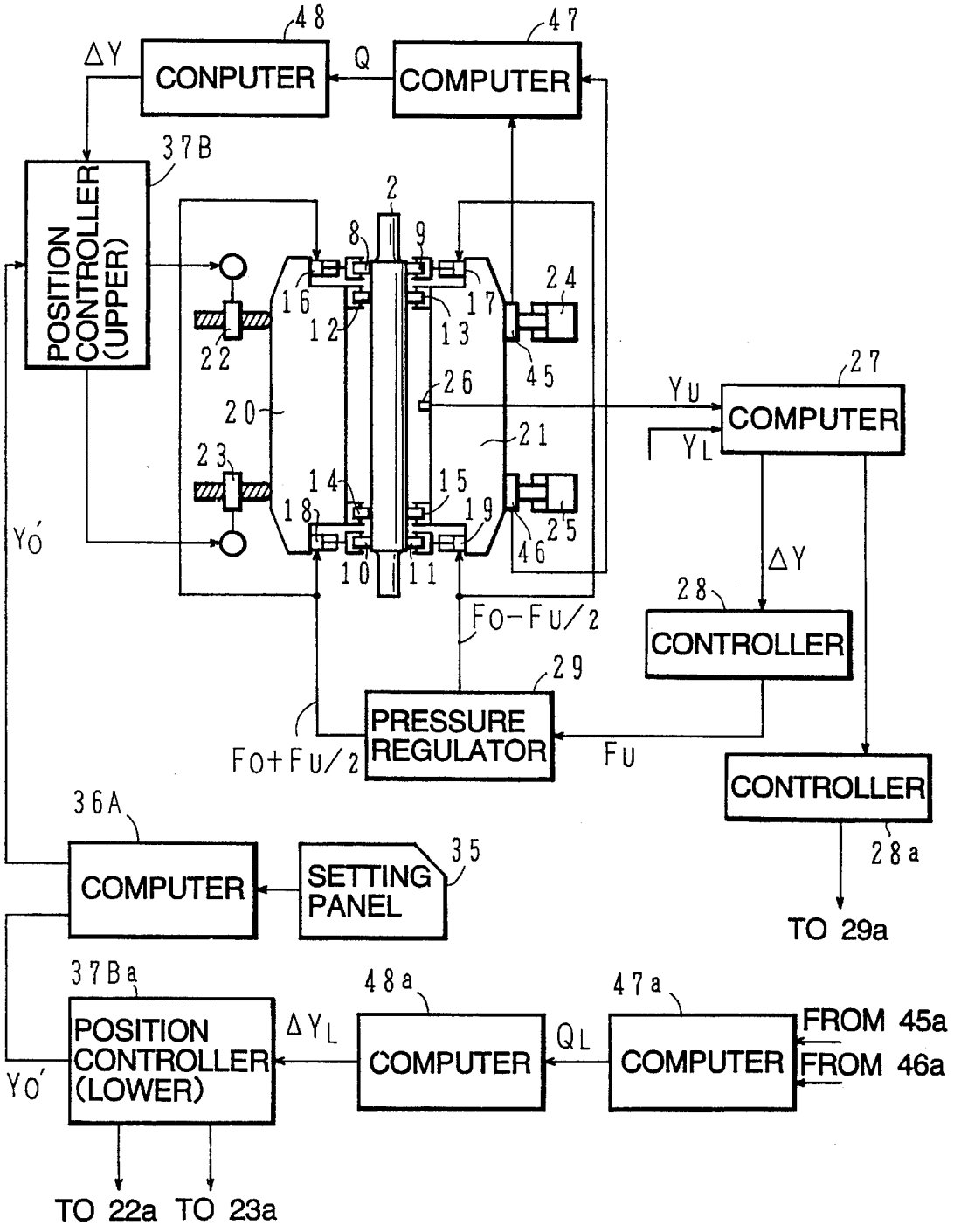
FIG. 17 is a schematic view of a rolling mill according to still another embodiment of the present invention.

Of course, the offset positions of the work rolls may be regulated so that the horizontal forces exerted on the upper and lower work rolls are both kept at 0. FIG. 17 shows an embodiment adapted for such a case. The upperside offset change ΔY from the computer 48 is supplied to an offset position controller 37B for the upper work roll. As with the case of the upper work roll 2, respective horizontal forces exerted on the lower work roll 3 are measured by load cells 45*a*, 46*a* (not shown) and a total value QL is determined by a computer 47*a*. A computer 48*a* calculates a lower-side offset change ΔYL by putting QL in the above Equation (27) instead of Q, and outputs it to a controller 37B*a* for the lower-side offset position regulators 22*a*, 23*a*. On the other hand, the offset position setting value YO' before the start of rolling is output to both the upper- and lower-side controllers 37B, 37B*a* in the same value for the upper and lower sides.

During the period from the start of rolling until a steady operating condition is reached, the horizontal forces exerted on the upper and lower work rolls are more likely to vary to a large extent. This embodiment is effective in such a transient operating condition, and performs the control so that the difference in horizontal deflection between the upper and lower sides under the offset position control becomes 0. Since the offset position is changed by, e.g., rotating a feed screw, the response speed is generally slow. Therefore, during the process before the work rolls are moved to the optimum offset positions, the horizontal deflection may occur. The horizontal deflection control is performed by the hydraulic cylinders and hence has a high response speed. As a result, the difference in horizontal deflection between the upper and lower sides is always kept at 0 during the roll movement and the stable rolling is achieved.

According to this embodiment, since the horizontal deflection is controlled to be kept small even in a transient operating condition rather than a steady rolling condition, it is possible to perform the rolling in a stable manner with superior control on shape or flatness.

While several embodiments of the present invention have been described, various modifications other than illustrated above can be made without departing from the spirit of the invention. For example, the invention is also applicable to a 4-high rolling mill in addition to the illustrated 6-high rolling mill. The horizontal deflection may be measured by traversing a single sensor. Further, the bending force may be practiced by, in addition to the method described above, applying a moment to each work roll chock or providing two work roll chocks for each end side so as to apply a couple.

What is claimed is:

1. A rolling method for use with a rolling mill comprising an upper and a lower work roll, upper and lower backup rolls, horizontal supporting means for respectively supporting said upper and lower work rolls in the horizontal direction, and horizontal bending means for respectively imparting a horizontal bending to said upper and lower work rolls, wherein:

said method comprises the steps of measuring horizontal deflections of said upper and lower work rolls during rolling, and controlling said horizontal bending means for at least one of said upper and lower work rolls so that a difference between a value measured on said upper work roll and a value measured on said lower work roll falls within a predetermined range.

2. A rolling method according to claim 1, wherein said step of controlling said horizontal bending means comprises comparing the value measured on said upper work roll and the value measured on said lower work roll, calculating the difference between the measured values, and controlling said horizontal bending means for at least one of said upper and lower work rolls when said difference exceeds a predetermined range, so that said difference always falls within the predetermined range.

3. A rolling method according to claim 1, further comprising the steps of measuring a horizontal deflection of at least one of said upper and lower work rolls at axially spaced positions during rolling, and controlling said horizontal bending means for said at least one work roll so that the difference between values measured at said axially spaced positions falls within a predetermined range.

4. A rolling method according to claim 1, wherein said upper and lower work rolls are set to predetermined offset positions which are determined by rolling conditions and at which strip shape is not affected by horizontal deflections of said work rolls, and then rolling is started and said horizontal bending means are controlled while holding said offset positions fixed during the rolling.

5. A rolling method according to claim 1, wherein said upper and lower work rolls are set to offset positions at which horizontal forces exerted on said work rolls become 0, and then rolling is started and said horizontal bending means are controlled.

6. A rolling method according to claim 5, further comprising the steps of measuring horizontal force exerted on at least one of said upper and lower work rolls during the rolling, and regulating the offset positions of said upper and lower work rolls so that a measured value of said horizontal force is kept not greater than a predetermined value.

7. A rolling method for use with a rolling mill comprising an upper and a lower work roll, upper and lower backup rolls, horizontal supporting means for respectively supporting said upper and lower work rolls in a horizontal direction, and horizontal bending means for respectively imparting a horizontal bending to said upper and lower work rolls, wherein:

said method comprises the steps of measuring a horizontal deflection of at least one of said upper and lower work rolls at axially spaced positions during rolling, and controlling said horizontal bending means for said at least one work roll so that a difference between values measured at said axially spaced positions falls within a predetermined range.

8. A rolling method according to claim 7, wherein said step of controlling said horizontal bending means comprises comparing the values measured at said axially spaced positions of said at least one work roll, calculating the difference between the measured values, and controlling said horizontal bending means for said at least one work roll when said difference exceeds a predetermined range, so that said difference always falls within the predetermined range.

9. A rolling method for use with a rolling mill comprising an upper and a lower work roll, upper and lower backup rolls, horizontal supporting means for respectively supporting said upper and lower work rolls in a horizontal direction, and horizontal bending means for respectively imparting a horizontal bending to said upper and lower work rolls, said upper and lower work rolls being disposed to be offset with respect to said upper and lower backup rolls in a direction of a pass line, wherein:

rolling is started after setting said upper and lower work rolls to predetermined offset positions which are determined by rolling conditions and at which strip shape is not affected by horizontal deflections of said work rolls.

10. A rolling method as in claim 9 wherein said setting said upper and lower work rolls to predetermined offset positions further comprises determining said offset positions responsive to a proportional constant, an influence coefficient of a horizontal effect, a work roll diameter, an intermediate roll diameter and strip thickness.

11. A rolling mill comprising an upper and a lower work roll, upper and lower backup rolls, horizontal supporting means for respectively supporting said upper and lower work rolls in a horizontal direction, and horizontal bending means for respectively imparting a horizontal bending to said an upper and a lower work roll, wherein:

said mill comprises means for measuring horizontal deflections of said upper and lower work rolls during rolling, and first horizontal deflection control means for controlling said horizontal bending means for at least one of said upper and lower work rolls so that a difference between a value measured on said upper work roll and a value measured on said lower work roll falls within a predetermined range.

12. A rolling mill according to claim 11, wherein said first horizontal deflection control means comprises means for comparing the value measured on said upper work roll and the value measured on said lower work roll and calculating the difference between the measured values, and means for determining whether said difference exceeds a predetermined range or not and controlling said horizontal bending means for at least one of said upper and lower work rolls when said difference exceeds the predetermined range, so that said difference always falls within the predetermined range.

13. A rolling mill according to claim 11, further comprising means for measuring a horizontal deflection of at least one of said upper and lower work rolls at axially spaced positions during rolling, and second horizontal deflection control means for controlling said horizontal bending means for said at least one work roll so that a difference between values measured at said axially spaced positions falls within a predetermined range.

14. A rolling mill according to claim 11, further comprising means for calculating predetermined offset positions which are determined by rolling conditions and at which strip shape is not affected by horizontal deflections of said an upper and a lower work rolls, and means for setting said work rolls to said offset positions.

15. A rolling mill according to claim 11, further comprising means for setting said upper and lower work rolls to offset positions at which horizontal forces exerted on said work rolls become 0.

16. A rolling mill according to claim 15, further comprising means for measuring horizontal force exerted on at least one of said upper and lower work rolls during rolling, and means for regulating the offset positions of said upper and lower work rolls so that a measured value of said horizontal force is kept not greater than a predetermined value.

17. A rolling mill comprising an upper and a lower work rolls, upper and lower backup rolls, horizontal supporting means for respectively supporting said upper and lower work rolls in a horizontal direction, and horizontal bending means for respectively imparting a horizontal bending to said an upper and a lower work roll, wherein:

said mill comprises means for measuring a horizontal deflection of at least one of said upper and lower work rolls at axially spaced positions during rolling, and horizontal deflection control means for controlling said horizontal bending means for said at least one work roll so that difference between values measured at said axially spaced positions falls within a predetermined range.

18. A rolling mill according to claim 17, wherein said horizontal deflection control means comprises means for comparing the values measured at said axially spaced positions of said at least one work roll and calculating a difference between the measured values, and means for determining whether said difference exceeds a predetermined range or not and controlling said horizontal bending means for said at least one work roll when said difference exceeds the predetermined range, so that said difference always falls within the predetermined range.

19. A rolling mill comprising an upper and a lower work roll, upper and lower backup rolls, horizontal supporting means for respectively supporting said upper and lower work rolls in a horizontal direction, and horizontal bending means for respectively imparting a horizontal bending to said an upper and a lower work rolls, said upper and lower work rolls being disposed to be offset with respect to said upper and lower backup rolls in a direction of a pass line, wherein:

said mill comprises means for calculating predetermined offset positions which are determined by rolling conditions and at which strip shape is not affected by horizontal deflections of said upper and lower work rolls, and means for setting said work rolls to said offset positions.

* * * * *

UNITED STATES PATENT AND TRADEMARK OFFICE

CERTIFICATE OF CORRECTION

PATENT NO. : 5,560,237

DATED : October 1, 1996

INVENTOR(S) : Kenichi Yasuda et al.

It is certified that error appears in the above-indentified patent and that said Letters Patent is hereby corrected as shown below:

Title page, item [73], Assignee:
Please add --Hitachi, Ltd. of Tokyo, Japan and Hitachi Nuclear Engineering Co., Inc. of Hitachi-shi, Japan-- as assignees of this patent.

Signed and Sealed this

Twenty-sixth Day of August, 1997

*Attest:*

*Attesting Officer*

BRUCE LEHMAN

*Commissioner of Patents and Trademarks*